US006407717B2

(12) United States Patent
Killen et al.

(10) Patent No.: US 6,407,717 B2
(45) **Date of Patent: *Jun. 18, 2002**

(54) PRINTED CIRCUIT BOARD-CONFIGURED DIPOLE ARRAY HAVING MATCHED IMPEDANCE-COUPLED MICROSTRIP FEED AND PARASITIC ELEMENTS FOR REDUCING SIDELOBES

(75) Inventors: William D. Killen, Satellite Beach; Heriberto J. Delgado, Melbourne, both of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/790,175

(22) Filed: Feb. 21, 2001

Related U.S. Application Data

(63) Continuation of application No. 09/543,161, filed on Apr. 4, 2000, now Pat. No. 6,195,062, which is a continuation of application No. 09/042,824, filed on Mar. 17, 1998, now Pat. No. 6,052,098.

(51) Int. Cl.[7] ..... H01Q 21/12; H01Q 9/28

(52) U.S. Cl. ..... 343/815; 343/795; 343/817; 343/818

(58) Field of Search ..... 343/795, 700 MS, 343/810, 815, 817, 818, 819, 833, 834

(56) References Cited

U.S. PATENT DOCUMENTS

| | | | | | |
|---|---|---|---|---|---|
| 2,897,497 | A | | 7/1959 | Finneburgh | 343/818 |
| 3,541,559 | A | | 11/1970 | Evans | 343/795 |
| 4,097,868 | A | | 6/1978 | Borowick | 343/795 |
| 4,186,400 | A | * | 1/1980 | Cermignani et al. | 343/708 |
| 4,290,071 | A | | 9/1981 | Fenwick | 343/819 |
| 4,514,734 | A | * | 4/1985 | Cermignani et al. | 343/708 |
| 4,812,855 | A | | 3/1989 | Coe et al. | 343/818 |
| 4,835,538 | A | * | 5/1989 | McKenna et al. | 343/700 MS |
| 5,231,406 | A | | 7/1993 | Sreenivas | 343/700 MS |
| 5,382,959 | A | | 1/1995 | Pett et al. | 343/700 MS |
| 5,612,706 | A | * | 3/1997 | Podell | 343/818 |
| 6,052,098 | A | * | 4/2000 | Killen et al. | 343/795 |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

To reduce sidelobes in the radiation pattern of a phased array dipole antenna, a plurality of parasitic antenna elements are provided adjacent to the array of dipole elements of the antenna. The driven elements of the dipole array and associated director elements are formed as patterned conductor elements on one surface of a thin dielectric substrate. Feed elements for the driven dipole array also comprise patterned conductor elements formed on an opposite surface of the substrate. The feed elements have a geometry and mutually overlapping projection relationship with the conductors of the driven dipole elements, so as to form a matched impedance transmission line through the dielectric substrate with the patterned dipole elements. The parasitic elements are formed on additional dielectric substrates spaced apart from and parallel to the thin dielectric substrate upon which the driven dipole array is formed.

5 Claims, 4 Drawing Sheets

PRINTED CIRCUIT BOARD-CONFIGURED DIPOLE ARRAY HAVING MATCHED IMPEDANCE-COUPLED MICROSTRIP FEED AND PARASITIC ELEMENTS FOR REDUCING SIDELOBES

This application is a continuation of Ser. No. 09/543,161 filed on Apr. 4, 2000, now U.S. Pat. No. 6,195,062, which is a continuation of Ser. No. 09/042,824 filed on Mar. 17, 1998, which is now U.S. Pat. No. 6,052,098 issued on Apr. 18, 2000.

FIELD OF THE INVENTION

The present invention relates in general to communication systems and components, and is particularly directed to a new and improved printed circuit board-configured dipole antenna array architecture, containing a plurality of parasitic elements that are spatially arranged in planes offset from and parallel to the plane containing the array of dipoles of the antenna, so as to provide a reduction in the sidelobes of the antenna array's radiation pattern.

BACKGROUND OF THE INVENTION

Communication system designers are constantly seeking ways to improve the performance of system components and signal processing circuits, without incurring a substantial cost or hardware complexity penalty. For example, radio wave system designers desire to maximize the collection or emission of desired electromagnetic energy and to minimize the coupling of unwanted radiation with respect to the system's antenna. In communication systems that employ dipole antennas and arrays, such as those mounted on aircraft, for example, improvements in directivity gain can be obtained by Yagi antenna configurations that employ parasitic elements in proximity to driven dipole radiators. For an illustration of documentation that describes use of parasitic elements in antenna architectures, especially for improving directivity gain, including those employing dipole antennas, attention may be directed to the Finneburgh U.S. Pat. No. 2,897,497; Cermignami et al, U.S. Pat. Nos. 4,186,400 and 4,514,734; Coe et al, U.S. Pat. No. 4,812,855; and Podell, U.S. Pat. No. 5,612,706.

In high user density environments such as cellular wireless systems, mutual interference is perhaps the most significant problem. Although cell and channel assignment algorithms provide some measure of interference rejection, the fact remains that optimal performance requires that systems of this type have the ability to maximize energy coupling (such as between a subscriber unit and a base station) in a relatively narrow main lobe (namely, place the antenna's main lobe 'right on top' of a target emitter/receiver). In addition, they should reduce/minimize, to the extent possible, energy that is present in lobes other than the main beam, namely from sources (of interference) other than that lying in the main beam.

SUMMARY OF THE INVENTION

In accordance with the present invention, this objective is achieved in a dipole antenna array, such as a phased array dipole antenna for producing a relatively narrow steerable beam, by providing a plurality of parasitic antenna elements that are arranged in planes parallel to and spaced apart from the dipole elements of the array, so as to effectively reduce unwanted sidelobes in the radiation pattern produced by the array.

Pursuant to a preferred embodiment of the invention, the driven elements of the dipole array and one or more director elements are formed as patterned conductor elements on a first, generally planar driven array-supporting dielectric substrate. Feed elements for the driven dipole array also include conductor elements formed on a second, opposite surface of the first, driven dipole array-supporting substrate. The feed elements have a geometry and mutually overlapping projection relationship with the conductors of the driven dipole elements, so as to form a matched impedance transmission line through the dielectric substrate with the driven dipole elements.

In addition, one or more parasitic (electrically floating) conductor elements are formed on a second, auxiliary dielectric substrate that is arranged parallel to and is spaced apart from a first side of the first dielectric substrate. These additional parasitic conductor elements are oriented parallel to the driven elements and function to reduce sidelobes in the radiation pattern exhibited by the antenna array. In like manner, one or more further parasitic conductor elements are formed on a third, auxiliary dielectric substrate that is arranged parallel to and is spaced apart from a second side of the first dielectric substrate. These further parasitic conductor elements are also oriented parallel to the driven elements on the first dielectric substrate and function to reduce sidelobes in the radiation pattern exhibited by the antenna array.

Namely, while the radiation pattern produced by the dipole antenna array is controlled by amplitude and phase of signals applied to the feed ports of the driven dipole array, because of the presence of the parasitic dipole elements on the second and third auxiliary substrates, the sidelobes of the antenna's radiation pattern are substantially reduced in comparison with a dipole array without parasitic elements of the invention.

DETAILED DESCRIPTION

Figure 1:
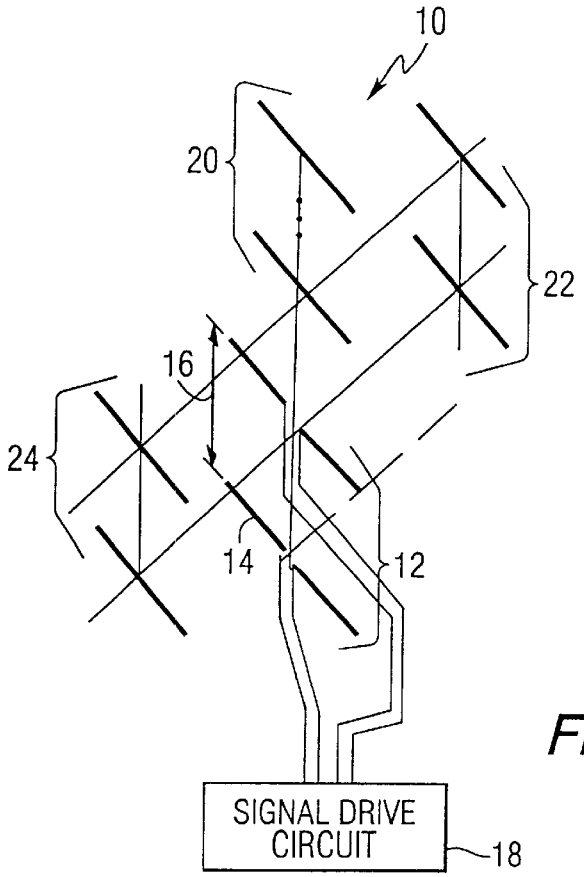
FIG. 1 is diagrammatically exploded view of a dipole antenna array having a plurality of sidelobe-reducing parasitic elements in accordance with the present invention.

A dipole antenna array having a plurality of spaced apart sidelobe-reducing parasitic elements in accordance with the present invention is shown diagrammatically in FIG. 1, as a dipole array 10 containing a plurality 12 of dipole antenna elements 14 arranged parallel to and spaced apart from one another by a prescribed distance 16 (e.g., a half-wavelength of the center frequency of the operating bandwidth of the antenna). In addition, one or more electrically floating, director dipole elements, a plurality of which are shown at 20, are disposed parallel to the dipole elements 14.

For the case of a steerable array, each of the dipole elements 14 may be driven at a prescribed amplitude and phase by means of an associated drive signal circuit 18

Figure 2:
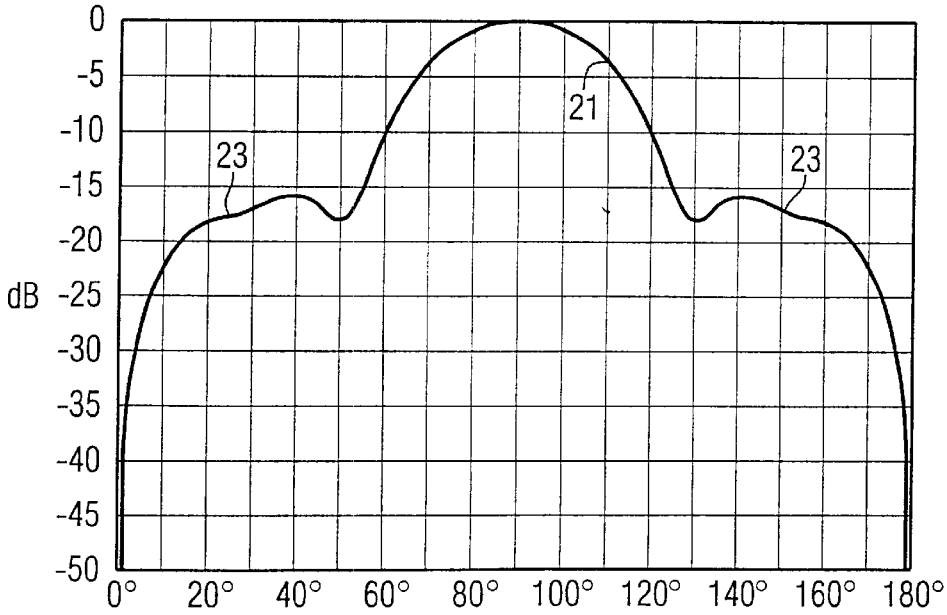
FIG. 2 PRIOR ART
FIG. 2 shows a radiation pattern associated with a conventional dipole antenna array having no parasitic elements.

(having one or more weighting elements, not shown), so that the plurality 12 of driven dipole elements 14 produces a prescribed radiation directivity pattern, such as that shown in FIG. 2, having a relatively narrow or focussed main lobe 21 and a plurality of (undesirable) sidelobes 23.

In accordance with the invention, the energy in the sidelobes 23 can be substantially reduced relative to that of the main beam 21 by the addition of a plurality of auxiliary parasitic (floating or non-driven) antenna elements 22 and 24 that are arranged adjacent to or spatially alongside the perimeter of the driven dipole elements 14. As will be described below with reference to FIG. 4, these parasitic antenna elements 22 and 24 may comprise one or more unloaded conductive (metallic) strips, as a non-limiting example, formed on respective dielectric substrates alongside a substrate supporting the driven elements 14 of the array 10. The parasitic elements 22 and 24 are disposed parallel to the elements 14 of the antenna dipole array 10 and, like the spacing between driven elements 14 of the array 10, have a relative mutual spacing and a separation from the driven elements 14 of the array, which may be on the order of a half-wavelength of the center frequency of the operating bandwidth of the antenna.

Figure 3:
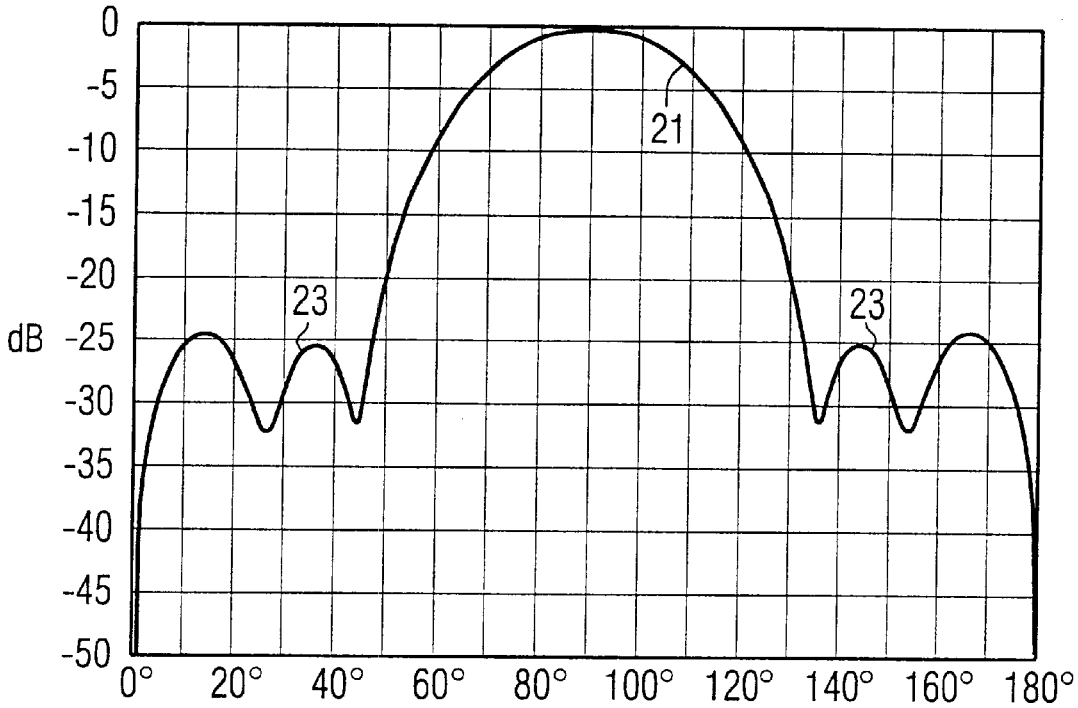
FIG. 3 shows the radiation pattern of the dipole array of FIG. 1 having its sidelobes reduced by parasitic elements in accordance with the present invention.

As can be seen from a comparison of the radiation pattern of FIG. 2 and that of FIG. 3, which is associated with a dipole array having parasitic elements in accordance with the present invention, incorporation of mutually spaced apart parasitic elements that are separated from the elements of the driven array is effective to provide a substantial reduction in the sidelobes 23 (on the order of ten dB in the illustrated example). It has been found that the addition of a single parasitic element or a pair of such parasitic elements adjacent to the driven dipole array is sufficient to provide a substantial reduction in the magnitude of the sidelobes, as shown in FIG. 3. Although the number of parasitic elements is not limited to this or any number, the use of parasitic elements in addition to a pair of such elements on either side of the array was not observed to provide a significant reduction in the magnitude of the sidelobes beyond that provided by two parasitic elements per set.

Figure 4:
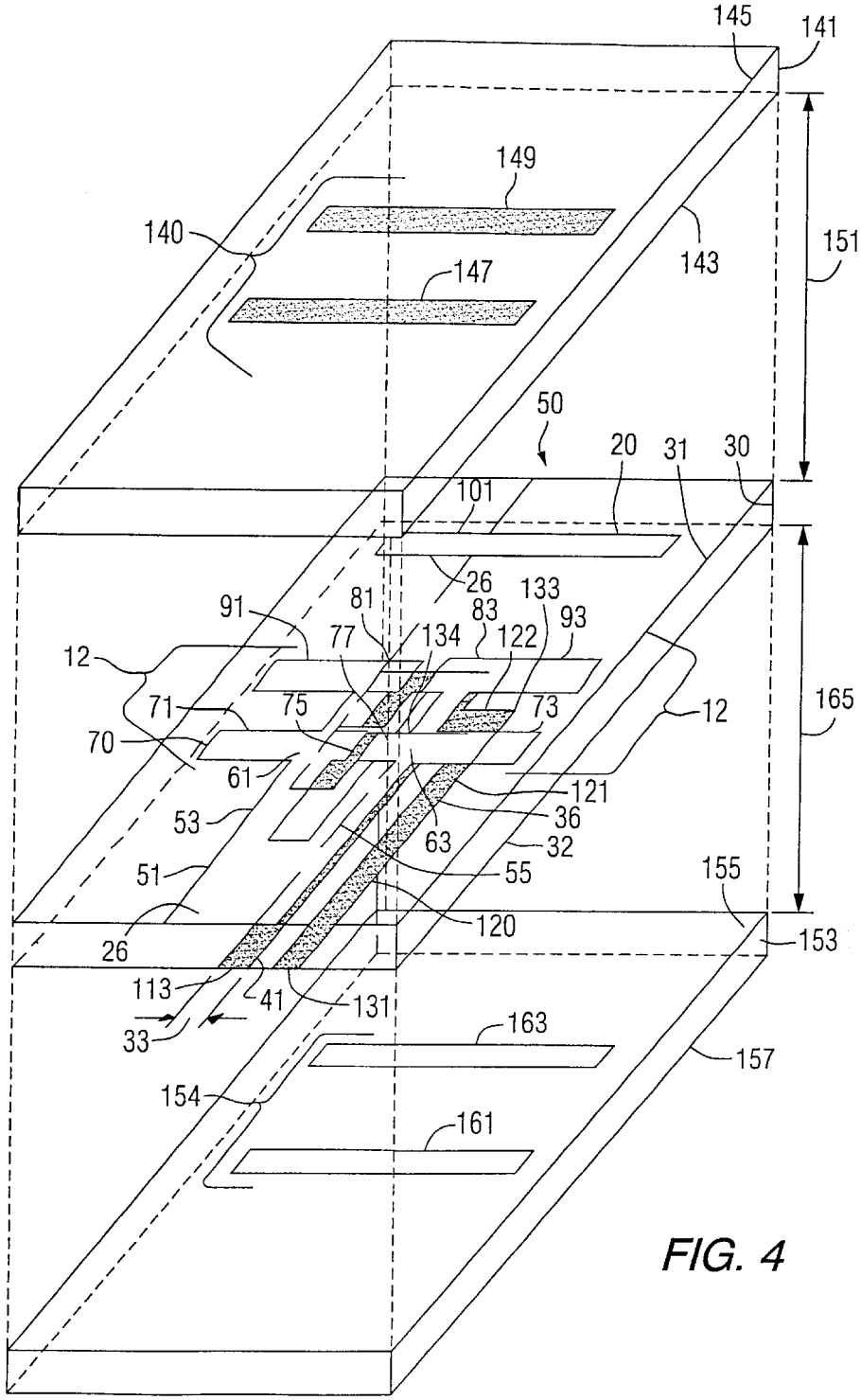
FIG. 4 is a diagrammatic exploded perspective view of a printed circuit architecture implementation of the dipole antenna array of FIG. 1.

FIG. 4 is a diagrammatic exploded perspective view of a printed circuit architecture implementation a dipole antenna array that includes parasitic elements arranged parallel to and spaced apart from the driven elements of the antenna array in accordance with the invention. In order to simplify the illustration, only a single dipole pair and adjacent parasitic elements of the arrangement of FIG. 1 are depicted in FIG. 4. As shown therein, the plurality 14 of active or driven dipole elements and an associated (single) director element 20 are formed as patterned conductor material 26 on a first surface 31 of a relatively thin, generally flat or planar dielectric substrate 30.

As a non-limiting example, for a dipole array operating at a center frequency on the order of ten to fourteen GHz, dielectric substrate 30 may be made of RT Duroid (Reg. Trademark) from the Microwave Materials Division of Rogers Corporation, Chandler, Ariz. 85224, which has a dielectric constant on the order of 3.48 and may have a thickness on the order of twenty mils. The conductor material 26 of which the dipole array 14 and the director element 20 are formed may comprise a relatively thin (e.g., 1.4 mils thickness, as a non-limiting example) layer of copper, gold and the like. This conductive layer may be non-selectively deposited on the entirety of the first surface 31 of the substrate 30, and then selectively masked and etched in a conventional manner, to realize the intended geometry of both the driven elements 14 of the dipole array 10 and their associated director element(s) 20.

In like manner, associated feed elements 41 for the plurality 12 of driven dipole elements 14 may be formed by selectively patterning a relatively thin (e.g., 1.4 mils thickness), conductor material 36 (the same as the conductive material 26) that has been non-selectively deposited on a second surface 32 of the substrate 30, opposite to the first surface 31. These feed elements 41 may be generally U-shaped, and have a width 33 and a prescribed spatial overlapping projection relationship with the patterned material 26 of the driven dipole elements 12 (in a direction orthogonal to the opposing parallel surfaces 31 and 32 of the substrate), so as to maintain a predetermined matched impedance characteristic (e.g., fifty ohms) and be coupled through the dielectric substrate with the driven dipole elements 12.

Figure 5:
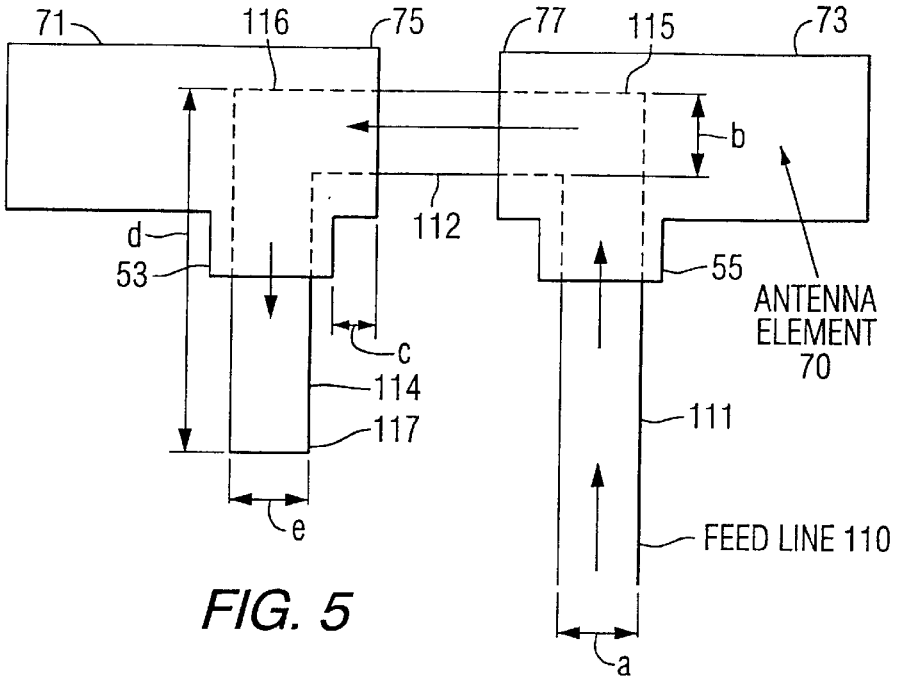
FIGS. 5 and 6 are respective diagrammatic plan views of portions of the printed circuit dipole antenna array architecture of FIG. 4, showing the mutual projection of the drive dipole elements and their associated feed elements.

To this end, as shown in the exploded view of FIG. 4, and as also in the plan view FIG. 5, which illustrates the mutual projection of the driven dipole elements and their associated feed elements of FIG. 4, the first layer of patterned conductor material 26 has a generally rectangularly shaped ground plane portion or region 51, from which first and second spaced apart and generally parallel rectilinear regions or strips 53 and 55 (each of which may have a line width of the order of eighteen mils) extend in parallel with a first linear axis 50.

At first locations 61 and 63 along parallel conductive strips 53 and 55, spaced apart from ground plane region 51, are respective first and second spaced apart collinear conductor arms 71 and 73 (which may also have a line width on the order of eighteen mils). The conductor arms 71 and 73 extend generally orthogonal to the conductor strips 53 and 55, and serve as dipole antenna elements of a first dipole antenna 70.

Relatively short segments 75 and 77 of the dipole arms 71, 73, respectively, protrude toward one another and from an underlying feed (as shown by protrusion distance 'c' in the diagrammatic plan view of FIG. 5), and serve as part of the matched impedance transmission line coupling between their associated feed conductor 41 patterned on the second surface 32 of the substrate 30, as shown in greater detail in FIG. 5.

Figure 6:
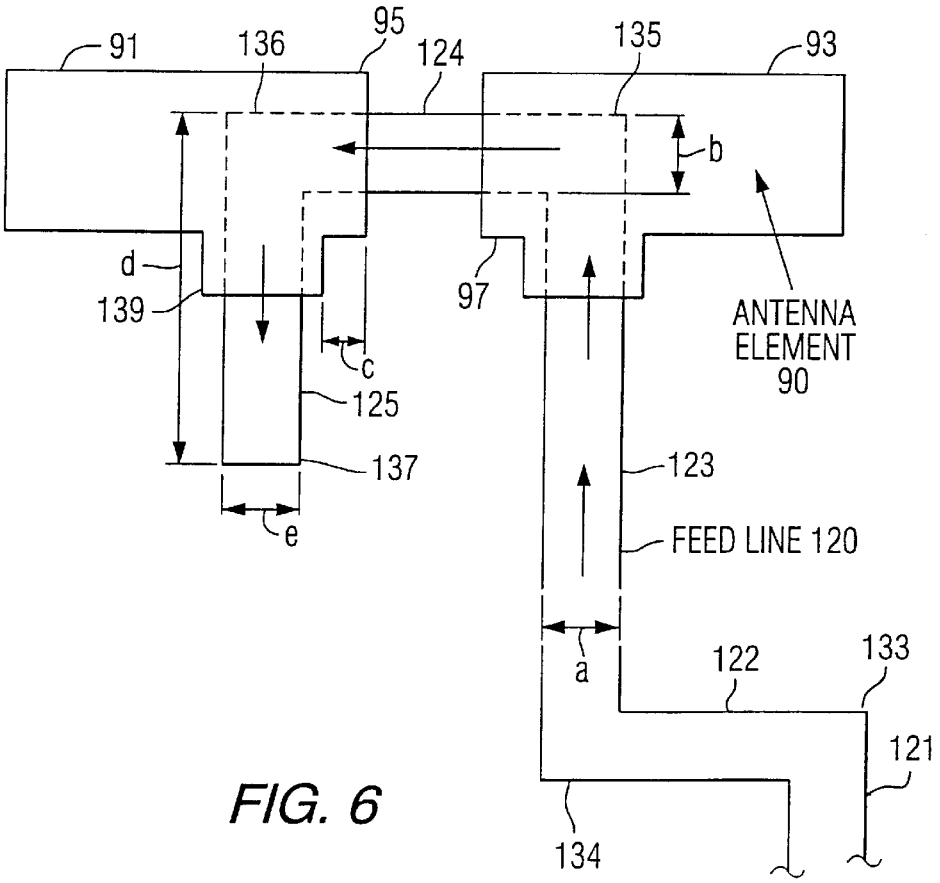

Extending from second locations 81 and 83 along the parallel conductive strips 53 and 55, spaced apart from respective locations 61 and 63 (by a spacing on the order of a half-wavelength), are respective third and fourth spaced apart conductor arms 91 and 93 (which may have a line width on the order of four mils) of a second dipole 90. Like dipole antenna arms 71 and 73 of dipole 70, each of conductor arms 91 and 93 extends generally orthogonal to the conductor strips 53 and 55, and serves as a respective dipole antenna element of second dipole antenna 90. Relatively short segments 95 and 97 of the dipole arms 91, 93, respectively, also protrude toward one another and beyond underlying feed conductors by a distance 'c' as shown in FIG. 6, to provide matched impedance coupling between their associated feed conductors on the second surface 32 of the substrate 30.

The first layer of patterned conductor material 26 further includes a generally elongated (rectangularly shaped) region 101 (which may have a line width of the order of fifteen mils), that extends in parallel with dipole antennas 70 and 90, and serves as a director dipole element. This director dipole conductor region 101 may have an overall length corresponding to the lengths of the dipole antennas 70 and 90, and is spaced apart from the outermost dipole arms 91 and 93 by a distance on the order of one-half wavelength of the antenna's center frequency, as described above.

To facilitate manufacturing of a feed-to-dipole coupling structure, rather than employ plated through-holes between the conductive material 26 and 36 on opposite surfaces 31 and 32 of the substrate 30, the geometries of the feed elements for the driven dipole pair 70 and 90 are sized and also have a mutually overlapping (orthogonal projection) relationship with the patterned material 26 of the driven dipole elements 70 and 90, so as to provide a matched impedance inductance-capacitance characteristic (e.g., on the order of fifty ohms) transmission line through the dielectric substrate 30 with the patterned dipole elements 70 and 90.

As shown in the diagrammatic plan view of FIG. 5, in accordance with this mutually overlapping projection relationship, the conductive material 36 on the second surface 32 is patterned to form a U-looped feed element 110 configured to maintain a prescribed matched impedance characteristic (e.g., fifty ohms) for the driven dipole pair 70. In particular, the feed element 110 for the first dipole 70 has a first conductive strip 111 of width 'a' that is parallel with and aligned (in overlapping projection) with conductive strip 55. The first conductive strip 111 extends from a feed port 113 (shown in FIG. 4) directly beneath the ground plane region 51 to a location 115 directly beneath dipole arm 73.

The feed element 110 further includes a second conductive strip 112 of width 'b', that is orthogonal to conductive strip 111 and extends therefrom to a third conductive strip 114 of width 'e'. The third conductive strip 114 extends from a location 116 directly beneath the intersection of dipole antenna arm 71 and conductive strip 53 to a location 117 a distance 'd' or a quarter-wavelength apart from location 116. What results is an open end quarter-wavelength transmission line formed between the mutually overlapping portions of the conductive material 26 and the feed element 110 having an impedance that is impedance matched to ancillary signal processing circuitry driving the antenna.

In like manner, as shown in the diagrammatic plan view of FIG. 6, the feed element 120 for dipole 90 has a first conductive strip 121, whose line width is that of the second dipole 90, and parallel to the conductive strip 55. As shown in FIG. 4, the first conductive strip 121 of feed element 120 extends from a feed port 131 located directly beneath the ground plane region 51 to a location 133 spaced apart from a location 134 directly beneath conductive strip 55 between locations 63 and 83 thereof. A second conductive coupling strip 122 is connected between locations 133 and 134.

Feed element 120 also includes a third conductive strip 123, that is arranged parallel to and is aligned with conductive strip 55. The third conductive strip 123 has a width 'a' and extends to a location 135 directly beneath conductive strip 93. Feed element 120 also has a fourth conductive strip 124 of width 'b', orthogonal to the third conductive strip 123 and extending to a fifth conductive strip 125 of width 'e'. The fifth conductive strip 125 extends from a location 136 directly beneath the intersection of the dipole antenna arm 91 and conductive strip 139 to a location 137, spaced distance 'd' or a quarter-wavelength apart from location 136. As in the first feed, such a 'looped' feed geometry provides an open end quarter-wavelength transmission line between mutually overlapping portions of the conductive material 26 and the feed element 120 and impedance-matched to that (e.g., fifty ohms) of the ancillary signal processing circuitry driving the antenna.

As further shown in the exploded view of FIG. 4, one or more 'upper' parasitic conductor elements, shown as a plurality 140 (e.g., pair) of conductor elements 147 and 149, are selectively formed on the lower surface 143 of an 'upper' dielectric substrate 141 having an upper surface 145. These upper (electrically floating) parasitic elements 147 and 149 correspond to one of the sets of 22 of parasitic elements of FIG. 1, and serve to reduce sidelobes in the antenna's radiation pattern.

The upper dielectric substrate 141 is parallel to the dielectric substrate 30 and is spaced apart from its upper surface 31 by a vertical separation distance 151. The upper substrate 141 may be formed of the same dielectric material and have the same thickness as dielectric substrate 30; also sidelobe-reducing parasitic elements 147 and 149 may be formed in the same manner as the dipole elements 12 on the substrate 30.

In like manner, one or more 'lower' parasitic conductor elements, shown as a plurality 154 (e.g., pair) of conductor elements 161 and 163, which correspond to the other of the sets of parasitic elements 22 and 24 of FIG. 1, are selectively formed on the upper surface 155 of a 'lower' dielectric substrate 153, which has a bottom surface 157. The lower dielectric substrate 153 is also parallel to the substrate 30 and is spaced apart from its lower surface 32 by a vertical separation distance 165. The lower dielectric substrate 153 may be also formed of the same material and be of the same thickness as the dielectric substrate 30, and parasitic elements 161 and 163 may be formed in the same manner as the dipole elements 12 on substrate 30. Like parasitic elements 147 and 149, parasitic elements 161 and 163 are electrically floating and function to reduce sidelobes in the radiation pattern exhibited by the antenna array.

As pointed out above, the radiation pattern produced by the dipole antenna array is dependent upon the amplitude and phase (relative weighting) of each of the signals applied to its feed ports. Because of the presence of the parasitic dipole elements, the sidelobes of the resulting radiation pattern are substantially reduced in comparison with a dipole array without parasitic elements, as can be seen from a comparison of FIGS. 2 and 3, referenced above.

As will be appreciated from the above description, the desire to maximize energy coupling in a relatively narrow main lobe and minimize energy in sidelobes—a frequent objective in high user density environments such as cellular wireless systems—is readily achievable in a phased array dipole antenna in accordance with the invention, which employs electrically floating, parasitic antenna elements that are spaced apart from the plane containing the dipole elements of the array. In a preferred implementation, the driven dipole elements of the array and their associated sidelobe-reducing parasitic elements are formed as patterned conductor elements on respective planar dielectric substrates.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed is:

1. An antenna comprising:

a generally planar arrangement of first antenna elements having an electromagnetic radiation pattern with sidelobes relative to a principal lobe thereof; and parasitic antenna elements spaced apart from a plane containing said first antenna elements and forming a three-dimensional arrangement of antenna elements with said first antenna elements, and being disposed in spatially separated planes on opposite sides of said plane at spatial positions that reduce said sidelobes in said electromagnetic radiation pattern.

2. The antenna according to claim 1, wherein said first antenna elements comprise dipoles.

3. The antenna according to claim 1, wherein said first antenna elements comprise an array of first antenna elements.

4. The antenna according to claim 1, wherein said first antenna elements are formed of a first patterned conductor on a first surface of a first dielectric substrate, and a second patterned conductor on a second surface of said dielectric substrate, opposite to said first surface thereof, said second patterned conductor having a prescribe spatial projection relationship with respect to, and providing a prescribed matched impedance coupling through, said first dielectric substrate with said first patterned conductor, and wherein electrical energy is supplied from a signal source to said second patterned conductor, so as to cause said electrical energy to be couple through said first dielectric substrate and into said first patterned conductor and radiated therefrom, and wherein said parasitic antenna elements comprise a plurality of additional patterned conductors, each having the geometry of a parasitic antenna elements, formed on a surface of a second dielectric substrate spaced apart from said first dielectric substrate, and wherein the geometry of said plurality of additional patterned conductors is such that spatial locations of said parasitic antenna elements, relative to said antenna elements on said first dielectric substrate, of said three-dimensional arrangement, reduce said sidelobes in said electromagnetic radiation pattern.

5. The antenna according to claim 4, wherein said additional patterned conductors comprise conductive strips which electrically float as parasitic antenna elements.

* * * * *